US006804477B2

(12) United States Patent
Maruyama

(10) Patent No.: US 6,804,477 B2
(45) Date of Patent: Oct. 12, 2004

(54) IMAGE FORMING APPARATUS AND METHOD FOR COMPENSATING FOR IRREGULAR RECORDING MATERIAL

(75) Inventor: Shoji Maruyama, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/238,717

(22) Filed: Sep. 11, 2002

(65) Prior Publication Data

US 2003/0052934 A1 Mar. 20, 2003

(30) Foreign Application Priority Data

Sep. 20, 2001 (JP) ..... 2001/286986

(51) Int. Cl.[7] ..... G03G 15/00
(52) U.S. Cl. ..... 399/45
(58) Field of Search ..... 399/45, 14, 15

(56) References Cited

U.S. PATENT DOCUMENTS

| | | | | |
|---|---|---|---|---|
| 4,549,803 | A | 10/1985 | Ohno et al. | |
| 5,138,392 | A | 8/1992 | Kinoshita et al. | |
| 5,208,628 | A * | 5/1993 | Ohashi et al. | |
| 5,689,760 | A * | 11/1997 | Suzuki et al. | 399/45 |
| 5,805,291 | A * | 9/1998 | Calvin et al. | |
| 5,861,620 | A * | 1/1999 | Takahashi et al. | |
| 5,889,554 | A * | 3/1999 | Mutze | |
| 6,179,418 | B1 * | 1/2001 | Mizoguchi et al. | |
| 6,385,406 | B1 * | 5/2002 | Funamizu et al. | 399/45 |
| 6,497,179 | B1 * | 12/2002 | Allen et al. | |
| 6,597,877 | B1 * | 7/2003 | Luque | 399/45 |
| 6,668,144 | B2 | 12/2003 | Maruyama | |
| 2002/0071688 | A1 * | 6/2002 | Maruyama | 399/45 |
| 2003/0072028 | A1 * | 4/2003 | Haines et al. | |

FOREIGN PATENT DOCUMENTS

| | | | | |
|---|---|---|---|---|
| DE | 41 13 560 | | 10/1991 | |
| JP | 64-88571 | | 4/1989 | |
| JP | 6-156813 | | 6/1994 | |
| JP | 8-30146 | | 2/1996 | |
| JP | 10-274904 | | 10/1998 | |
| JP | 10274904 | A * | 10/1998 | G03G/15/20 |
| JP | 10288919 | A * | 10/1998 | G03G/21/00 |
| JP | 11170678 | A * | 6/1999 | B41J/29/48 |
| JP | 2000-111402 | | 4/2000 | |
| JP | 2000355443 | A * | 12/2000 | G03G/15/00 |

* cited by examiner

*Primary Examiner*—Susan Lee
(74) *Attorney, Agent, or Firm*—Fitzpatrick, Cella, Harper & Scinto

(57) ABSTRACT

The invention can prevent problems due to the feeding of an OHT sheet for ink jet, such as damaging a fixing device or deterioration of the image, as well as damaging of the fixing device due to the feeding of a sheet with a thickness exceeding a regular thickness, and can transmit related information to the user, so as to enhance reliability and usability of the image forming apparatus. The image forming apparatus includes a feeding unit for feeding a recording material, an image forming unit for forming an image on the recording material fed by the feeding unit, a reading unit capable of reading an image of an area including a portion of a surface of the recording material fed by the feeding unit, a determining unit for determining whether or not the recording material is an irregular recording material, based on the image read by the reading unit, and a controlling unit for stopping or suppressing a specific operation of the apparatus, when it is determined by the determining unit that the recording material is an irregular recording material.

24 Claims, 7 Drawing Sheets

IMAGE FORMING APPARATUS AND METHOD FOR COMPENSATING FOR IRREGULAR RECORDING MATERIAL

BACKGROUND OF THE INVENTION

1. Field of the Invention

The present invention relates to an image forming apparatus such as a copying machine or a laser printer or the like.

2. Related Background Art

In image forming apparatus such as copying machines or laser printers or the like, an image developed on a photosensitive member is transferred onto a recording material. Such image forming apparatus are provided with fixing devices for applying heat and pressure to the recording material on which the image has been transferred under specific fixing conditions so as to fix the image on the recording material.

Such conventional image forming apparatus are equipped with transmissive sensors for automatically detecting whether or not a recording material is an OHT sheet (i.e. an overhead transparent sheet). If the transmissive sensor detects that the recording material transmits light, it is determined that the recording material is an OHT sheet, while if the transmissive sensor detects that the recording material does not transmit light, it is determined that the recording material is a normal paper sheet. Thus, the fixing temperature or speed of the recording sheet under the fixing is set in accordance with a control based on the determination. Specifically, in the case of treating the OHT sheet, the image forming apparatus is so controlled as to increase the fixing temperature or to reduce the speed of the recording sheet passing through the fixing device, since it is necessary to stabilize and enhance the fixing of developer in order to maintain or enhance the transparency of the OHT sheet.

In general, the surfaces of OHT sheets for use in ink jet printers are being coated with a fixing agent for enhancing the fixing of the ink. In the past, if such an OHT sheet for use in ink jet printers is mistakenly fed to a copying machine or a laser printer or the like, the fixing agent on the OHP sheet for ink jet printers is melted by the heated fixing device to stick to the surface of a fixing roller. Consequently, the OHT sheet would entangle on the fixing roller to bring about not only jam in the sheet discharging but also, in the worst case, damage of a fixing roller guide or breaking of the fixing roller, which are worrying problems.

Even if the OHT sheet does not entangle on the fixing roller, there is a problem that a recording sheet that is subsequently fed would be contaminated with the fixing agent adhering on the fixing roller so that the image is deteriorated.

On the other hand, the transmissive sensors for discriminating the OHT sheet equipped in conventional image forming apparatus cannot detect whether or not an OHT sheet is coated with a fixing agent, though it can discriminate whether the recording material is a normal paper sheet or an OHT sheet. Therefore, if a user mistakenly feeds the image forming apparatus with an OHT sheet for ink jet printers, the printing is effected with a setting of fixing conditions according to a normal mode for OHT sheets, and the user would not notice that the recording material was mistakenly fed.

Furthermore, there has been another problem involving the fixing device. That is, if the user mistakenly sets a recording material having a thickness exceeding a prescribed regular thickness, the recording material cannot get into the fixing rollers, so that the recording material gets jammed so as to be corrugated, or that the thick recording material exerts an excessive pressure on a bearing of the fixing roller so as to break the fixing device.

SUMMARY OF THE INVENTION

The present invention has been made in view of the situations described above. An object of the invention is to prevent problems due to the feeding of an OHT sheet for ink jet, such as damaging of the fixing device or deterioration of the image, as well as damaging of the fixing device due to the feeding of a sheet with a thickness exceeding a regular thickness, and to give related information to the user, so as to provide an image forming apparatus and a control method thereof with which reliability and usability of the image forming apparatus can be enhanced.

According to the present invention, there is provided an image forming apparatus comprising, feeding means for feeding a recording material; image forming means for forming an image on the recording material fed by the feeding means; reading means capable of reading an image of an area including a portion of a surface of the recording material fed by the feeding means; determining means for determining whether or not the recording material is an irregular recording material, based on the image read by the reading means; and controlling means for stopping or suppressing, when it is determined by the determining means that the recording material is an irregular recording material, a specific operation of the apparatus.

According to the invention there is also provided a method of controlling an image forming apparatus in which a recording material is fed and an image is formed on the recording material that is being fed, comprising, a reading step of reading an image of an area including a portion of a surface of the recording material that is being fed; a determining step of determining whether or not the recording material is an irregular recording material, based on the image that has been read; and a controlling step of, when it is determined in the determining step that said recording material is an irregular recording material, stopping or suppressing a specific operation of the apparatus.

Other objects, features and advantages of the present invention will be readily apparent from the following description and the drawings.

DETAILED DESCRIPTION OF THE PREFERRED EMBODIMENTS

In the following, embodiments of the image forming apparatus according to the present invention will be described with reference to the drawings.

Figure 1:
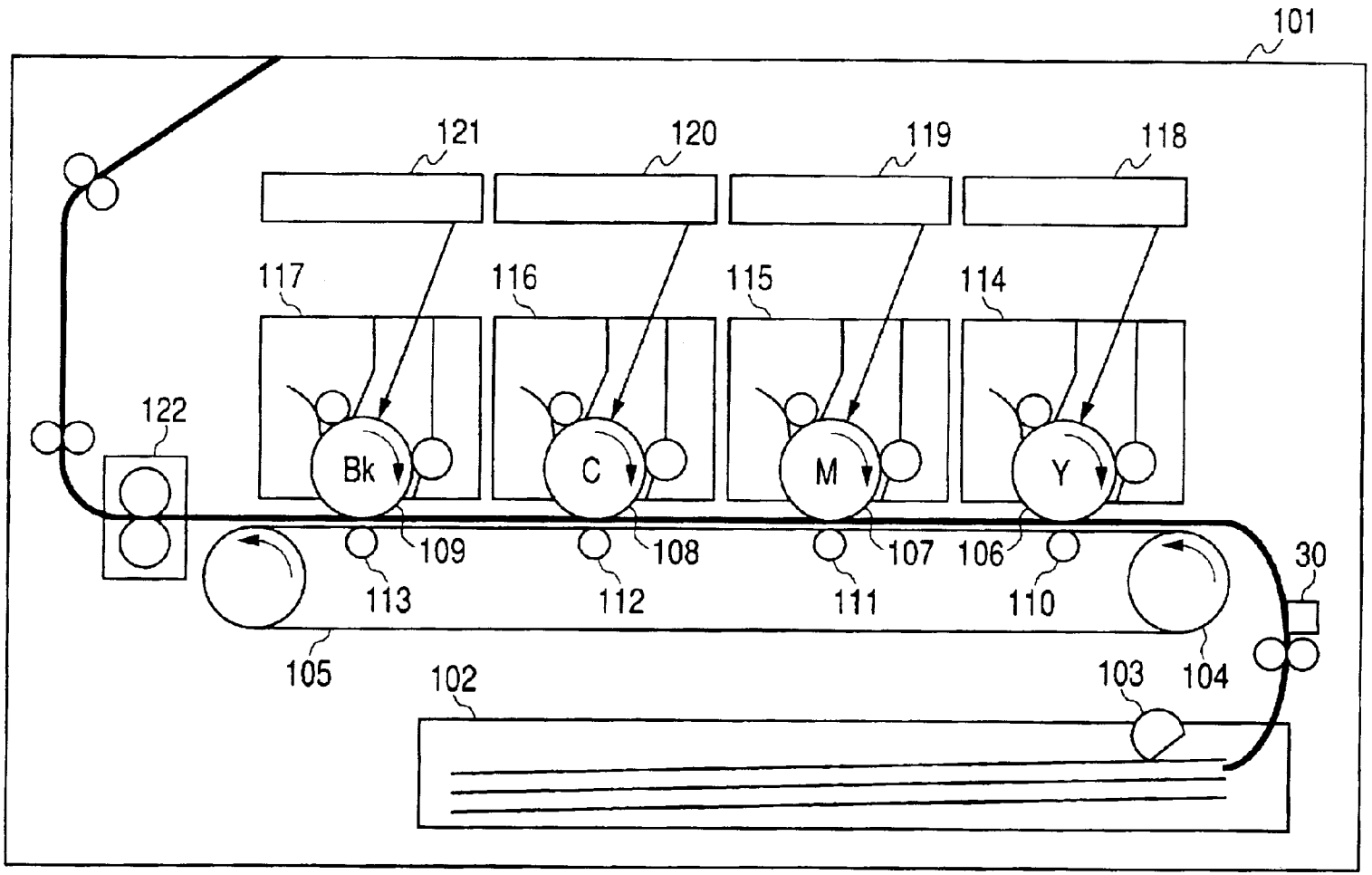
FIG. 1 is a cross-sectional view schematically illustrating the structure of the image forming apparatus according to the invention.
Figure 2:
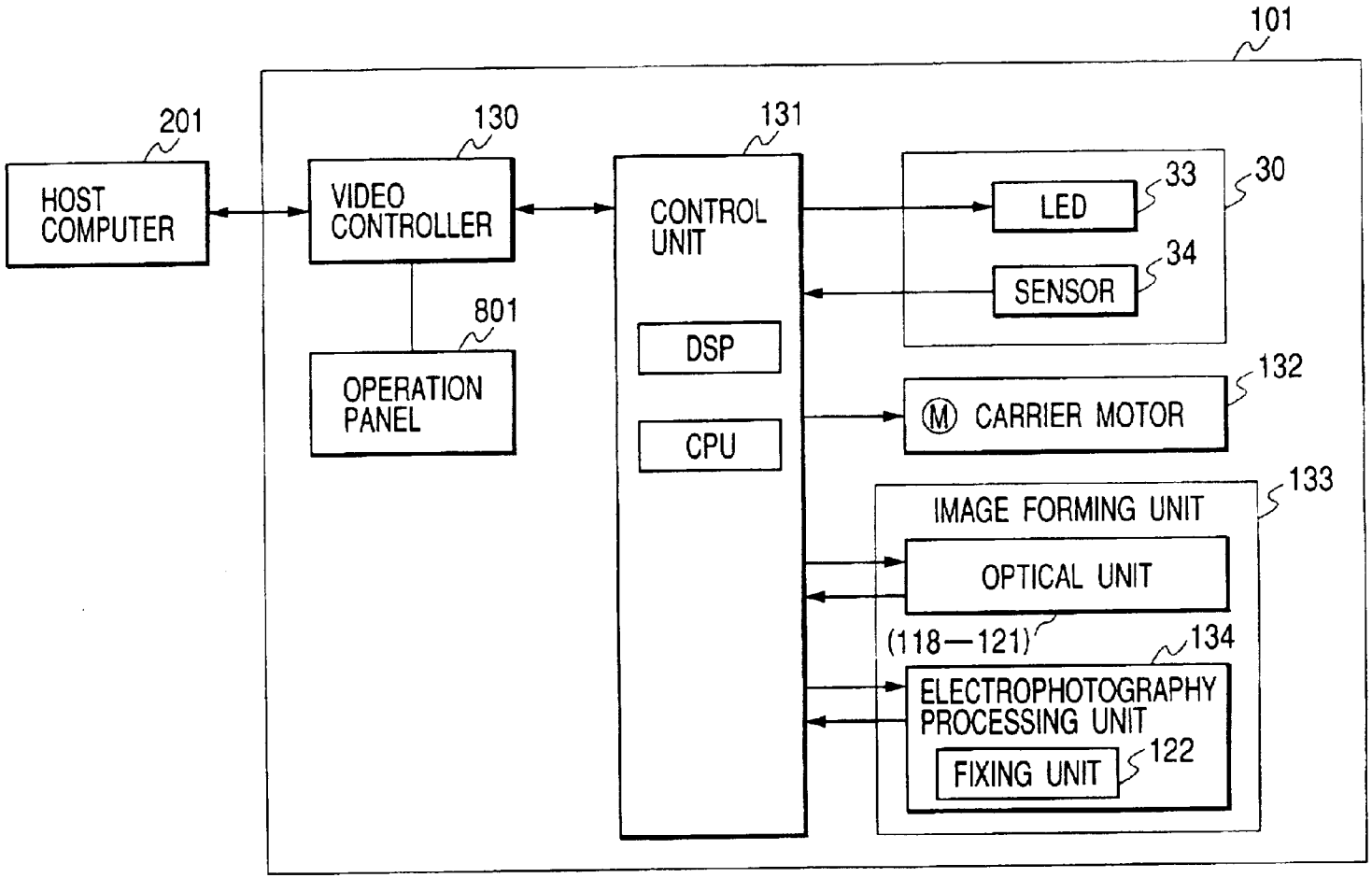
FIG. 2 is a block diagram showing an electrical system of the image forming apparatus according to the invention.
Figure 3:
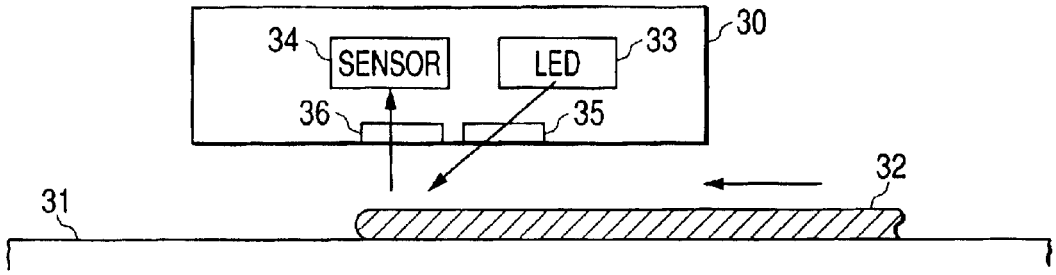
FIG. 3 is a cross-sectional view schematically illustrating the structure of image reading means provided in the image forming apparatus according to the present invention.
Figure 4A:
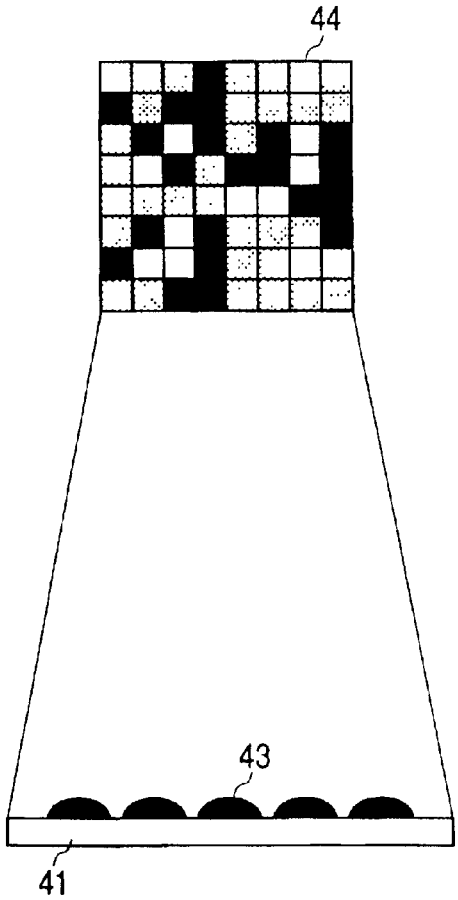
FIG. 4A is a drawing illustrating an example of a digitally processed image of the surface of an OHT sheet for ink jet printers read by the image reading means.
Figure 4B:
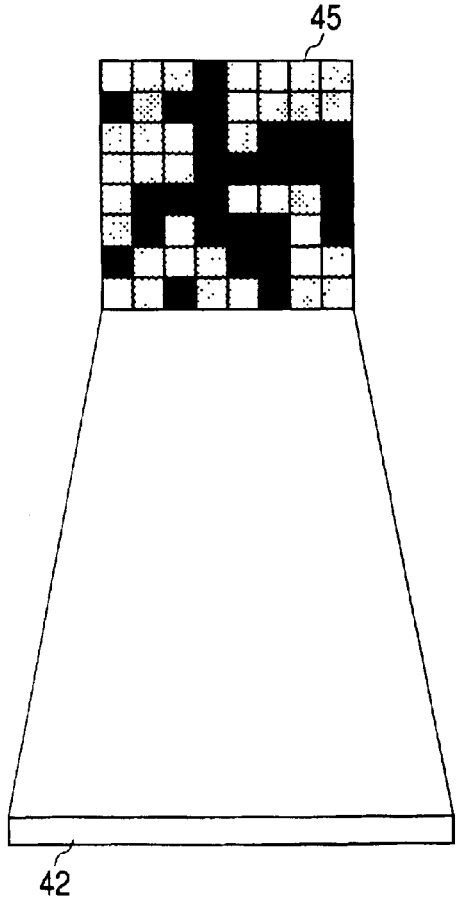
FIG. 4B is a drawing illustrating an example of a digitally processed image of the surface of an OHT sheet for LBP read by the image reading means.
Figure 5:
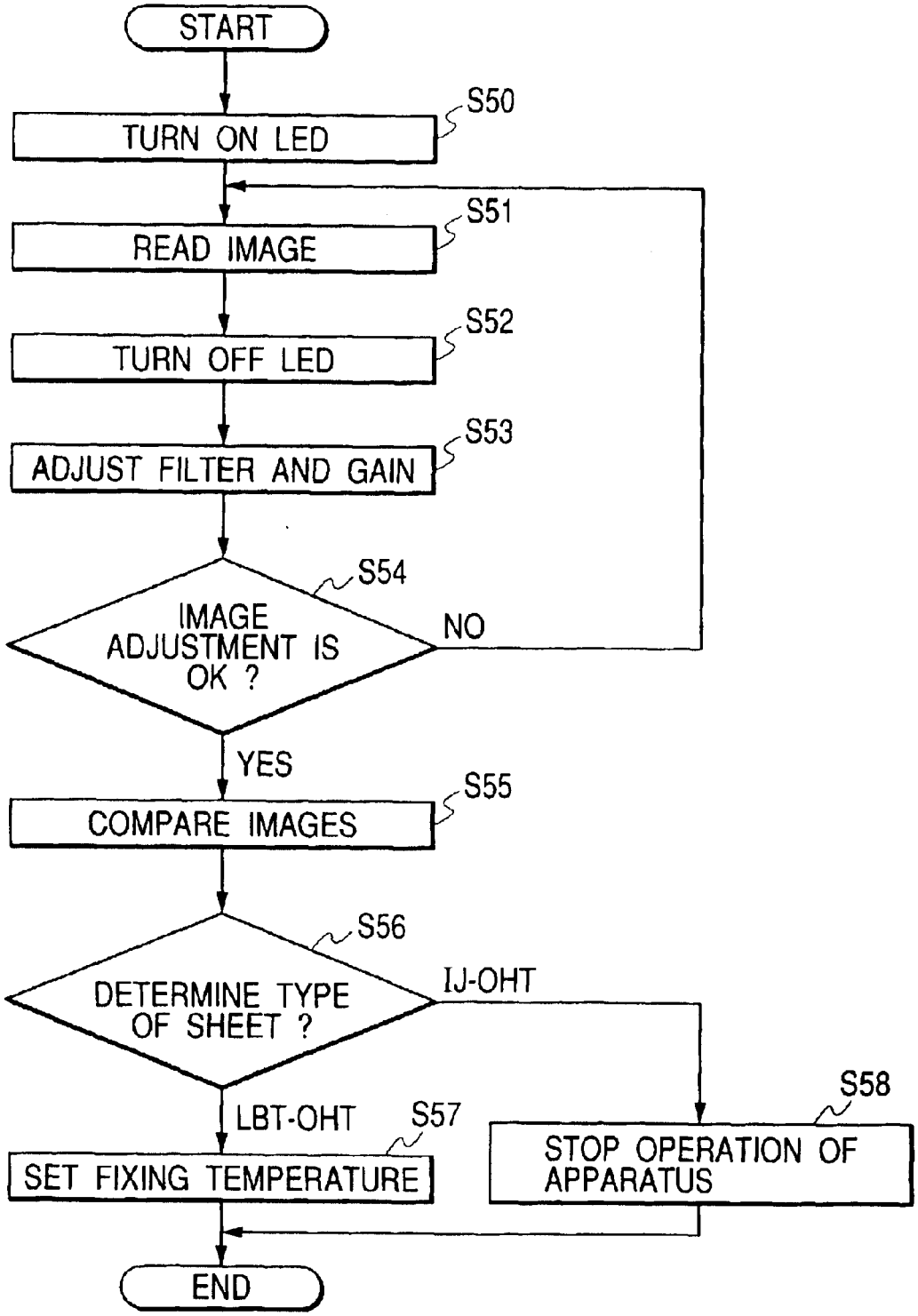
FIG. 5 is a flow chart showing a control process for fixing in the first embodiment of the invention.
Figure 6:
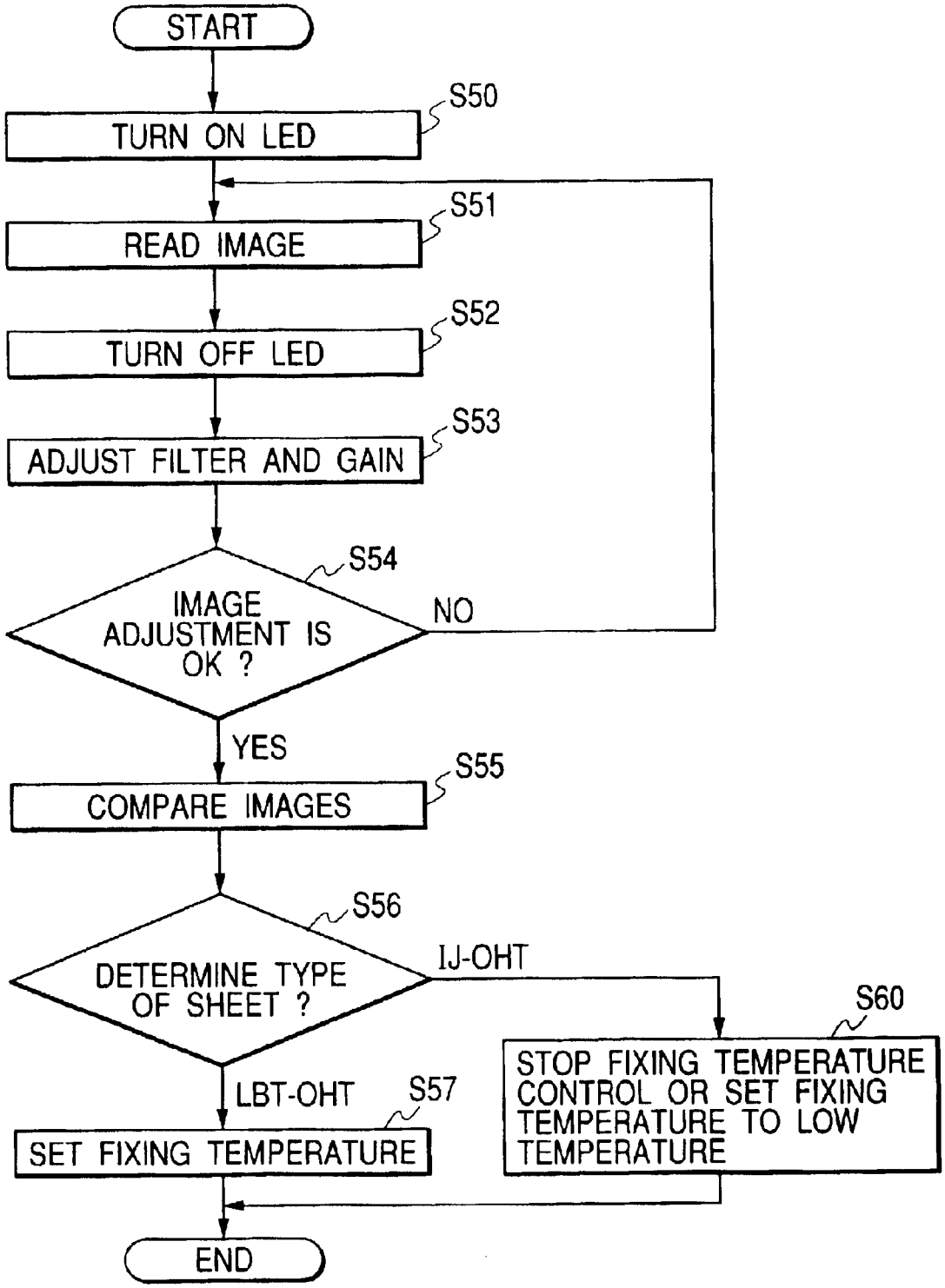
FIG. 6 is a flow chart showing a control process for fixing in the second embodiment of the invention.
Figure 7:
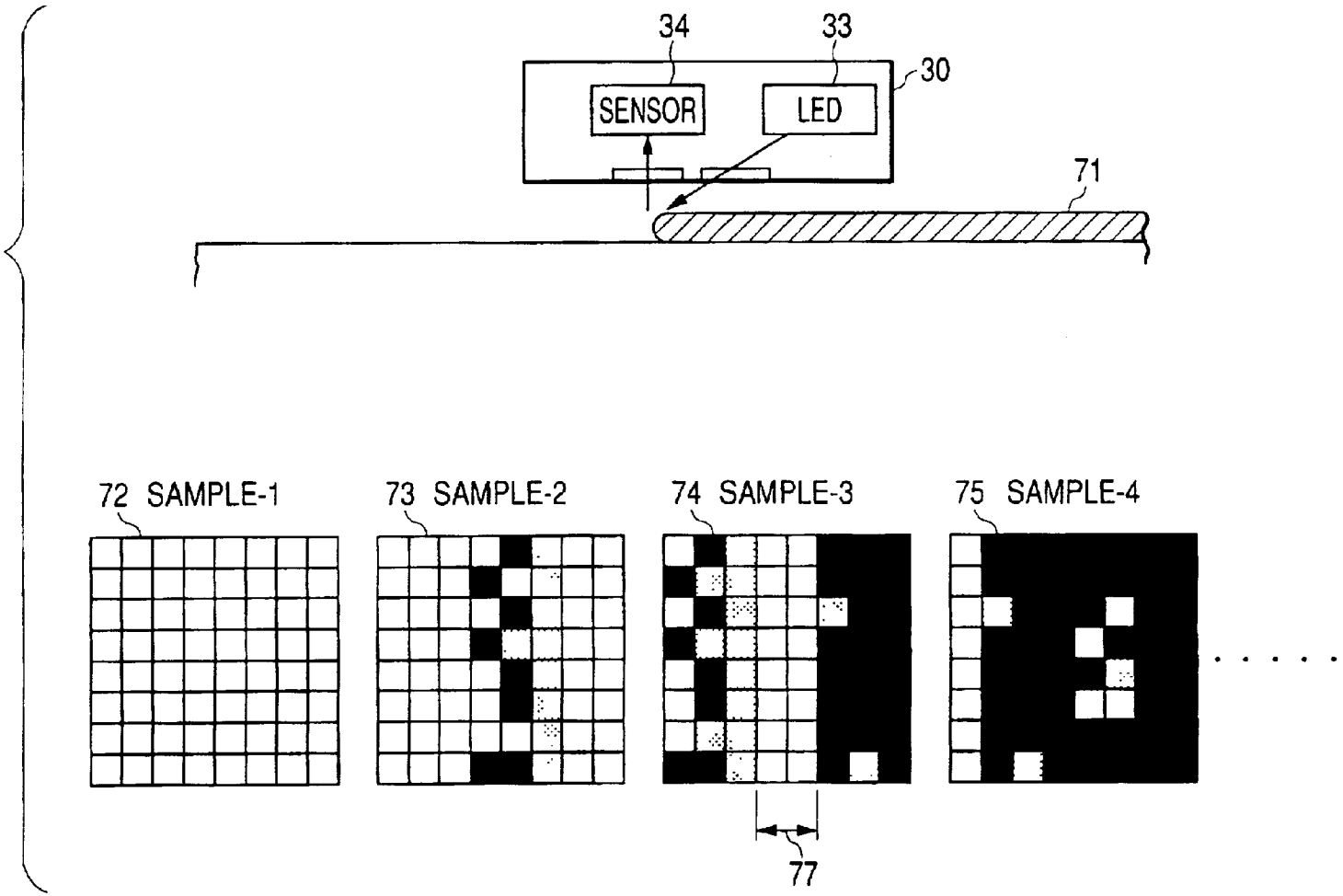
FIG. 7 is a drawing illustrating examples of digitally processed images of a leading edge portion of a recording material read by the image reading means in the third embodiment of the invention.
Figure 8:
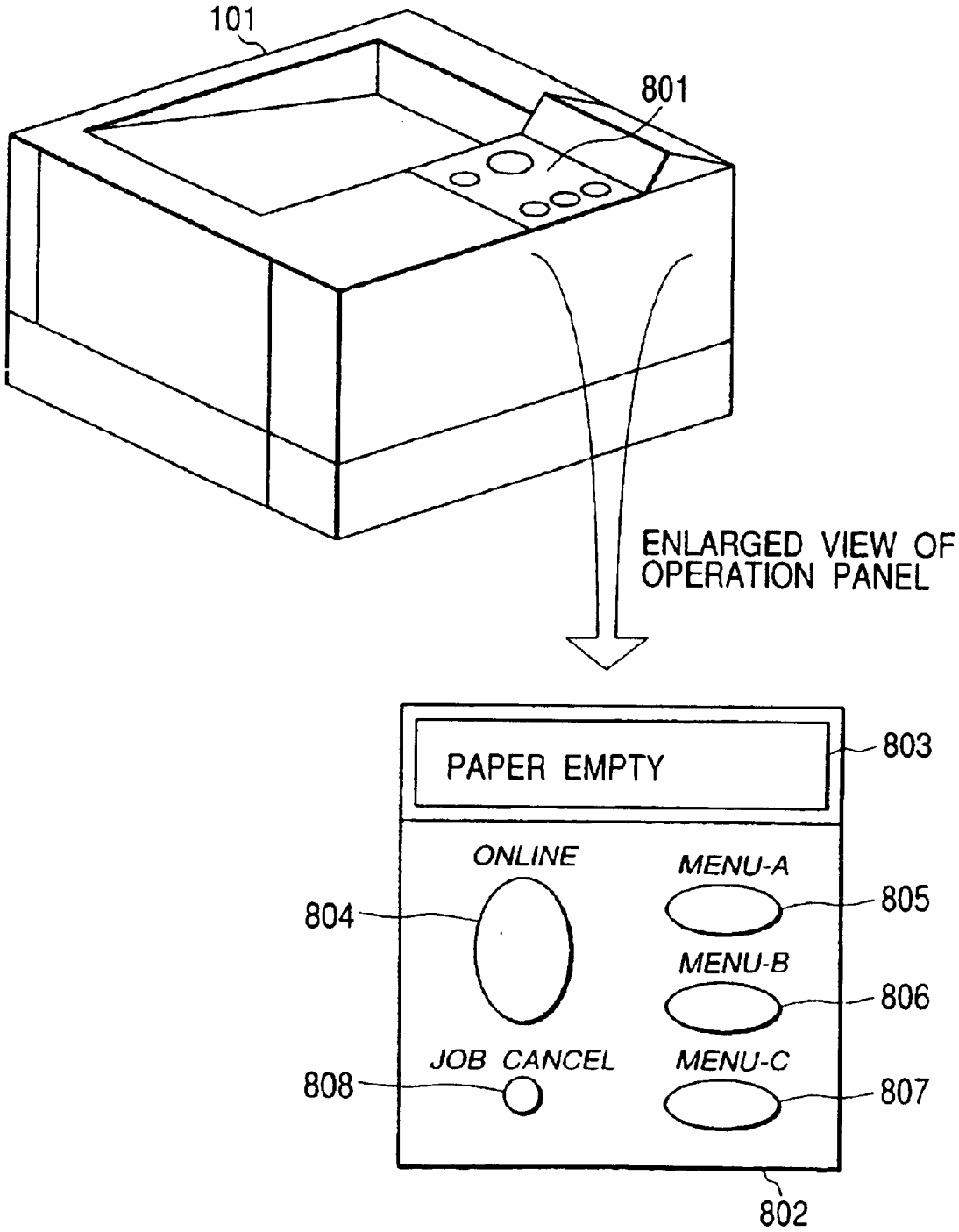
FIG. 8 is a perspective view schematically showing display means for indicating information to the user in the fourth embodiment of the invention.

FIG. 1 is a cross-sectional view schematically illustrating the structure of the image forming apparatus according to the invention. FIG. 2 is a block diagram showing an electrical system of the image forming apparatus according to the invention. FIG. 3 is a cross-sectional view schematically illustrating the structure of image reading means provided in the image forming apparatus according to the present invention. FIG. 4A is a drawing illustrating an example of a digitally processed image of the surface of an OHT sheet for ink jet printers read by the image reading means. FIG. 4B is a drawing illustrating an example of a digitally processed image of the surface of an OHT sheet for LBP read by the image reading means. FIG. 5 is a flow chart showing a control process for fixing in the first embodiment of the invention. FIG. 6 is a flow chart showing a control process for fixing in the second embodiment of the invention. FIG. 7 is a drawing illustrating examples of digitally processed images of a leading edge portion of a recording material read by the image reading means in the third embodiment of the invention. FIG. 8 is a perspective view schematically showing display means for indicating information to the user in the fourth embodiment of the invention.

Embodiment 1

As shown in FIG. 1, the image forming apparatus 101 as an embodiment of the present invention is provided with a paper sheet cassette 102, a feeding roller 103, a transferring belt driving roller (i.e., a roller for driving a transferring belt) 104, a transfer belt 105, photosensitive drums functioning as latent image bearing bodies 106 to 109, transferring rollers 110 to 113 functioning as transferring means, cartridges 114 to 117, optical units 118 to 121, and a fixing unit 122 serving as a fixing device, etc. The image forming apparatus 101 utilizes an electrophotography process, in which toner images of respective colors (i.e., yellow, magenta, cyan and black) are transferred and superposed onto a recording material as a recording medium, and then heated at a specific temperature and pressurized by a fixing roller (not shown) of the fixing unit 122, so that the toner images on the recording material are fixed.

The optical units 118 to 121 of the respective colors are applied to scan surfaces of the respective photosensitive drums 106 to 109 with laser beams so as to form latent images. A series of these image forming operations is so controlled in a synchronized manner that the images would be transferred onto the recording material, which is being carried forward, at a predetermined position thereon. The latent images formed on the respective photosensitive drums 106 to 109 are visualized as toner images by developing apparatus (not shown) provided in the cartridges 114 to 117, with developers (or toners) of respective colors.

The image forming apparatus 101 is further provided with a sheet feeding motor (not shown) for feeding and carrying recording materials, a transferring belt driving motor (not shown) for driving the transferring belt driving roller 104, a photosensitive drum driving motor (not shown) for driving the photosensitive drums 106 to 109 of the respective colors and the transferring rollers 110 to 113, and a fixing drum driving motor (not shown) for driving the fixing roller.

The image forming apparatus 101 is still further provided with image reading means 30, which illuminates the surface of a recording material fed from the paper sheet cassette 102 by the feeding roller 103 with light and detects an image of a specific area on the recording material by condensing the reflected light from the recording material to form the image.

In the following an electric system of the image forming apparatus according to this embodiment will be described with reference to FIG. 2. In FIG. 2, reference numeral 201 denotes a host computer. As shown in FIG. 2, the image forming apparatus 101 includes a video controller 130 which receives a printing job from the host computer and generates an image data in a raster form, a control unit 131 which includes a CPU and a DSP (digital signal processor) etc. for controlling various signal processing and operations of principal portions of the image forming apparatus, image reading means 30 which will be specifically described later, and carrying motors 132 for driving various carrying rollers. Reference numeral 134 denotes an image forming unit, which is comprised of four optical units and an electrophotography processing unit including the fixing unit, etc, as described in the foregoing. In this connection, the video controller 130 is connected also to an operation panel 801, which will be specifically described later in the description of the fourth embodiment.

In the following, a description will be made of the general outline of the structure of the image reading means 30 with reference to FIG. 3. As shown in FIG. 3, the image reading means 30 has an LED 33 serving as illuminating means, a sensor 34 such as a CMOS sensor etc. serving as reading means, a lens 35 serving as an imaging lens, and a lens 36 serving as a condenser lens.

Light emitted from the LED 33 as the light source illuminates, via the lens 35, the surface of a recording material carrying guide 31 or the surface of the recording material 32 on the recording material carrying guide 31. Reflected light from the recording material carrying guide 31 or the recording material 32 is condensed by the lens 36 and focused into an image on the sensor 34 such as a CMOS sensor. Thus, an image of the surface of the recording material carrying guide 31 or the recording material 32 is photoelectrically converted so as to be read.

In the arrangement of this embodiment, the LED 33 is disposed in such a way that the light emitted from the LED 33 illuminates the surface of the recording material from an oblique direction at a certain angle of incidence, as indicated by an arrow in FIG. 3.

FIGS. 4A and 4B show surfaces of OHT sheets read by the sensor 34 such as a CMOS sensor as well as images obtained by digitally processing outputs from the sensor 34 into 8×8 pixels. This digital processing is effected by converting an analog output from the sensor 34 such as a CMOS sensor into 8-bit pixel data by an A/D (i.e. analog-to-digital) converter (not shown) as converting means.

In FIGS. 4A and 4B, reference numeral 41 denotes an OHT sheet for ink jet printers (IJ-OHT) and reference numeral 42 denotes an OHT sheet for laser beam printers (LBP-OHT). The surface of the OHT 41 for ink jet printers is coated with fixing agent 43.

An image 44 (FIG. 4A) and an image 45 (FIG. 4B) are examples of images obtained by digitally processing images of the surface of the OHT sheets read into the sensor 34 such as a CMOS sensor. The surface of the OHT for ink jet printers is made uneven with the fixing agent, so in the image 44, bright portions (depicted as white squares) and dark portions (depicted as black squares) are detected. On the other hand, the surface of the OHT for laser beam printers is flat and oblique illumination light incident thereon is almost regularly reflected, so the image 45 is black (or dark) as shown in FIG. 4B, since the regularly reflected light does not impinge on the sensor 34 such as a CMOS sensor disposed directly above the illuminated area.

As described above, since the uneveness of the surface is different between the OHT sheet for ink jet printers and the OHT sheet for laser beam printers, the ratio of the irregular (or diffused) reflection component and the regular reflection component resulting from the illumination light, which is slantwise illuminated, is different between those OHT sheets, so that there is a difference between the respective images read into the sensor 34 such as a CMOS sensor.

Even if the OHT for ink jet is reversed, the sensor 34 such as a CMOS sensor detects irregular reflection light, and an image similar to the image 44 can be obtained.

Based on the image comparison, it is possible to discriminate between the OHT sheet for ink jet and the OHT sheet for laser beam. The image comparison is performed by a CPU, MPU or DSP, which compares an image with a preset image(s) of the OHT sheet for ink jet printers and a preset image(s) of the OHT sheet for laser beam printers to effect discrimination. Alternatively, the discrimination may be effected by performing a calculation for the comparison by means of a hardware circuit and transmitting the result of the calculation to the CPU, MPU or DSP.

In the following, a control flow executed by a control processor serving as fixing control means provided in the image forming apparatus will be described with reference to FIG. 5.

First, the LED is turned on in step S50, and in step S51, an image of a recording material is read by the sensor 34 such as a CMOS sensor. The reading of the image is effected plural times at a plurality of positions on the recording material. After the LED 33 is turned off in step S52, constants (numerical constants) used for a gain calculation and a filter calculation effected by gain adjusting means and filter calculating means (not shown), both of which are provided in the control processor, are adjusted in step S53. The gain calculation and filter calculation, which are programmable, are executed by the control processor.

The gain calculation is executed by, for example, adjusting the gain of the analog output from the sensor such as a CMOS sensor. When a quantity of reflected light from the surface of the recording material is too large or too small and the image of the surface of the recording material is hard to read or changes in the image cannot be derived, the gain should be adjusted.

The filter calculation is effected, for example, in a case in which the analog output of the sensor 34 such as a CMOS sensor is A/D-converted into 8-bit digital data (i.e., 256 tones), by multiplying the data by 1/32, 1/16, or 1/4, etc. Thus, noise components in the output of the sensor 34 are eliminated.

Next, in step S54, it is determined whether or not image information sufficient for effecting the image comparison calculation can be obtained. When in the affirmative in step S56, that is, when it is determined that sufficient information can be obtained, the image comparison calculation (which will be described later) is effected in step S55. Then in step S56, the type of the sheet (or recording material) is determined based on the result of the image comparison calculation, and the process proceeds to the control process corresponding to the determined type of the sheet. Specifically, when it is determined that the sheet of the recording material is an OHT sheet for laser beam printers (LBP-OHT), the process proceeds to step S57, in which a fixing temperature suitable for the LBP-OHT is set. On the other hand, when it is determined that the sheet is an OHT sheet for ink jet printers (IJ-OHT), the process proceed to step S58, in which sequential image forming operations, such as a control of the fixing temperature and a control of the carrying of the recording material, are stopped, that is, the operation of the apparatus is stopped.

As per the above, in this embodiment, the condition of the surface of the recording material that has been fed is detected and it is discriminated by a calculation means whether the recording material is an OHT sheet for ink jet printers or an OHT sheet for laser beam printers, based on the result of the detection. Thus, if it is determined that the sheet that has been fed is an OHT sheet for ink jet printers, the carrying of the recording material is stopped before the recording material is carried to the fixing device, so that entangling of the OHT sheet to the fixing device or jam of the OHT sheet can be prevented from occurring.

Embodiment 2

In the following, a description will be made of the second embodiment of the invention.

FIG. 6 is a flow chart showing a process for controlling the fixing. In the flow chart of FIG. 6, steps S50 to S57 are the same as those in the first embodiment that have been described above with reference to FIG. 5, so the descriptions thereof are omitted.

When, in step 56, it is determined that the recording material sheet is an OHT sheet for ink jet printers, control of the temperature of the fixing device is stopped or the temperature of the fixing device is set to a temperature lower than a normally set temperature, in step S60.

As per the above, in this embodiment, when it is determined that the recording material is an OHT sheet for ink jet printers, which is an irregular recording material unsuitable for the image forming apparatus, the temperature adjustment of the fixing device is stopped so that the OHT sheet for ink jet printers is discharged from the apparatus without undergoing the fixing processing, instead of stopping the carrying of the recording material. Alternatively, the temperature of the fixing device is set lower than the normal temperature that is set in normal printing.

If the carrying of the recording material is stopped upon detecting that the recording material is an OHT sheet for ink jet printers, it is necessary for the user to open a cover of the image forming apparatus so as to remove the OHT sheet in the feeding path, which raises such a problem that the operationality of the apparatus deteriorates. In the arrangement of this second embodiment, since the OHT sheet for ink jet is discharged from the apparatus, the user is free from the above-mentioned operation, while the apparatus can provide an advantageous effect similar to that of the first embodiment.

Embodiment 3

The third embodiment of the invention features an arrangement that detects the thickness of the recording material and stops the carrying of the recording material like the process in the first embodiment, when it is determined that the recording material has an irregular thickness that falls out of a regular (or allowable) thickness range.

FIG. 7 is a drawing illustrating examples of images capturing leading edge portions of a recording material read by the sensor 34 such as a CMOS sensor of the image reading means 30, which was specifically described in the first embodiment. In FIG. 7, reference numeral 71 denotes the recording material and reference numerals 72 to 76 denote sampled images arranged in a time series.

Specifically, these sampled images are examples of images that are sampled (or captured) sequentially while the leading edge portion of the recording material is passing by the image reading means 30. Image sample-1 denoted by reference numeral 72 is an image sampled under a state in which the leading edge of the recording material 71 has not reached the image reading means 30 yet. Image sample-2 denoted by reference numeral 73, which is sampled next, is an image sampled under a state in which the leading edge of the recording material has just reached the image reading means 30. In this state, the width or area of a pattern in the sampled image that represents a shadow of the recording material varies depending on the thickness of the recording material. In the examples shown in FIG. 7, the width or area representing the shadow that is generated proportional to the thickness of the recording material is two pixels wide as denoted by reference numeral 77.

Since the recording material is being carried forward during the sampling, the pattern of the images shifts or changes, as will be seen from image sample-3 denoted by numeral 74 and image sample-4 denoted by numeral 75, as the sampling is sequentially effected.

As per the above, as images of the leading edge portion of the recording material that is being carried are read periodically, the width or area representing the shadow proportional to the thickness of the recording material varies. Thus, the thickness can be detected by determining the width or length (i.e. the number of corresponding pixels) in the direction of carrying the recording material.

Then, it is possible to determine easily whether or not the thickness of the recording material is irregular (or exceeding a regular thickness) by, for example, comparing the detected thickness of the recording material with a reference value, which is stored in a memory such as an EEPROM (not shown) in advance, corresponding to a regular thickness of the recording material.

When it is determined that the thickness of the recording material falls out of the regular thickness range, the carrying of the recording material is stopped in a manner like the process in the first embodiment. The control process to be followed after it is determined that the recording material is regular is the same as that described in the first embodiment, so the description thereof is omitted.

As per the above, in this third embodiment, the thickness of the recording material is detected, and the recording material having a thickness exceeding the regular thickness is prevented from being carried to the fixing device. Therefore, damaging of the fixing device can be prevented form occurring.

Embodiment 4

In the following a description will be made of the fourth embodiment of the invention.

FIG. 8 is a perspective view showing display means of an image forming apparatus 101 as an embodiment of the present invention. In FIG. 8, reference numeral 801 denotes an operation panel of the image forming apparatus 101. The operation panel 801 is also separately shown in a magnified manner in FIG. 8.

Upon receiving a command from a host computer (not shown), based on printing conditions set through the operation panel 801, the image forming apparatus 101 feeds a recording material from a designated feeding cassette and prints an image on the recording material.

The operation panel 801 is comprised of a key operation unit 802 for allowing the user to set printing conditions freely and a display 803 for displaying conditions of the image forming apparatus 101 and various modes selected by the user. For example, when the image forming apparatus is in a condition capable of printing, "READY" is indicated on the display 803, and when a jam is occurring in the image forming apparatus 101, "JAM" is indicated on the display 803 to inform the user of the condition of the apparatus.

If the user mistakenly sets an irregular recording material, which is unsuitable for use in the image forming apparatus 101, to a sheet feeding unit of the apparatus and directs printing, then an image of the surface of the recording material that is fed is read by the sensor such as a CMOS sensor of the image reading means 30 described in the first and second embodiments, so that it is determined whether or not the recording material is a sheet suitable for use in the image forming apparatus 101. When it is determined that the recording material is an irregular one unsuitable for the apparatus, "UNSUITABLE PAPER" is indicated on the display 803.

If an image forming apparatus does not have a display as described above, the same information may be indicated on a personal computer (not shown) connected to the image forming apparatus.

As per the above, in this embodiment, when the user sets an irregular recording material that is unsuitable for the image forming apparatus, the apparatus informs the user of the setting of the irregular recording material. Thus, a user-friendly image forming apparatus can be realized.

As a storage medium for storing a program for realizing the control method of the image forming apparatus according to this embodiment, a nonvolatile storage such as a magnetic disk, an optical disk, a magnetooptical disk, or a magnetic tape (for example, FD, HD, CD-ROM, and CD-R, etc.) is mainly used. However the storage medium is not limited to them, and other storage media may also be used.

As has been described, the image forming apparatus according to one aspect of the invention comprises image reading means having an area sensor such as a CMOS sensor for reading an image of the surface of a recording material that is fed and means for determining, based on the resulting image, whether the recording material is an OHT for ink jet printers or OHT for laser beam printers. The apparatus of the invention also comprises means for stopping, when it is determined that the recording material is an OHT for ink jet printers, the carrying of the recording material to the fixing device along with the image forming operation of the apparatus; or alternatively control means that, when it is determined that the recording material is an OHT for ink jet printers, stops the temperature control of the fixing device or sets the temperature of the fixing apparatus to a temperature lower than a normal temperature. With these features, the invention can eliminate problems such as entangling of the OHT sheet to the fixing roller and deterioration of the image formed on the recording material that would occur when the user mistakenly sets or feeds an OHT sheet for ink jet printers that is an irregular recording material unsuitable for the apparatus. Therefore, the invention can provide an image forming apparatus that has higher reliability.

An image forming apparatus according to another aspect of the invention comprises means for reading an image of a leading edge portion of a recording material by an image reading sensor such as a CMOS sensor and detecting the thickness of the recording material based on the resulting image, and means for determining whether the thickness of the recording material is larger than a prescribed regular thickness. In this apparatus, when it is determined that the thickness of the recording material is larger than the regular thickness, the carrying of the recording material to the fixing device and the image forming operation of the apparatus are stopped. With these features, it is possible to prevent damaging of the fixing device ascribable to the feeding of a recording material thicker than the regular thickness to the fixing device from occurring. Therefore, the invention can provide an image forming apparatus that has higher reliability.

According to still another aspect of the invention, the image forming apparatus comprises means for informing, when the user mistakenly sets an irregular recording medium unsuitable for the apparatus, the user of a warning indicating that the irregular recording medium is set. Thus, the invention can enhance usability of the image forming apparatus.

While the present invention has been described with reference to some preferred embodiments, the invention is not confined to them and this application is intended to cover such modifications or changes as may come within the purposes of the improvements or the scope of the following claims.

What is claimed is:

1. A method of controlling an image forming apparatus which feeds a recording material and forms an image on the recording material, said method comprising steps of:

reading an area including a surface of a fed recording material and generating an image comprising a plurality of pixels each representing a brightness or a darkness;

determining whether or not the fed recording material is an irregular recording material, based on the generated image; and stopping or suppressing a specific operation of the apparatus, when determined that the fed recording material is an irregular recording material.

2. A method according to claim 1, wherein the image forming apparatus forms an image by an electrophotography process, and said method further comprises a step of determining whether or not the fed recording material is an OHT sheet for ink jet printers.

3. A method according to claim 1, wherein the image forming apparatus includes a transferring unit for transferring a toner image onto the recording material and a fixing unit for fixing the toner image on the recording material.

4. A method according to claim 3, further comprising a step of stopping an operation of the fixing unit, when determined that the fed recording material is an irregular recording material.

5. A method according to claim 3, further comprising a step of reducing a temperature of the fixing unit, when determined that the fed recording material is an irregular recording material.

6. A method according to claim 5, further comprising a step of discharging the recording material after reducing the temperature of the fixing unit.

7. A method according to claim 1, further comprising a step of informing a user of the determination that the recording material is an irregular recording material.

8. A method according to claim 1, wherein said reading step uses a reading unit comprising:

an illuminating unit adapted to illuminate an object;

an imaging lens adapted to form an image with reflected light from the object; and a convertor adapted to photoelectrically convert the image formed with the reflected light.

9. A method according to claim 8, wherein the illuminating unit illuminates the recording material obliquely from above, and the convertor receives diffusedly reflected light from the object.

10. A method according to claim 8, wherein the convertor comprises a CCD comprised of a plurality of pixels.

11. A method according to claim 8, wherein the convertor comprises a C-MOS sensor comprised of a plurality of pixels.

12. An image forming apparatus comprising:

a feeding unit adapted to feed a recording material;

an image forming unit adapted to form an image on the recording material fed by said feeding unit;

a reading unit capable of reading an area including a surface of the recording material fed by said feeding unit and adapted to generate an image comprising a plurality of pixels each representing a brightness or a darkness;

a determining unit adapted to determine whether or not the recording material is an irregular recording material, based on the generated image; and a controlling unit adapted to stop or suppress a specific operation of said apparatus, when determined that the recording material is an irregular recording material.

13. A method of controlling an image forming apparatus which feeds a recording material and forms an image on the recording material, said method comprising steps of:

reading an area including a shadow of an edge of a fed recording material and generating an image comprising a plurality of pixels each representing a brightness or a darkness;

determining whether or not the fed recording material is an irregular recording material, based on a size of the shadow comprised of the generated image; and stopping or suppressing a specific operation of the apparatus, when determined that the fed recording material is an irregular recording material.

14. A method according to claim 13, wherein the image forming apparatus forms an image by an electrophotography process, and said method further comprises a step of determining whether or not the fed recording material is an OHT sheet for ink jet printers.

15. A method according to claim 13, wherein the image forming apparatus includes a transferring unit for transferring a toner image onto the recording material and a fixing unit for fixing the toner image on the recording material.

16. A method according to claim 15, further comprising a step of stopping an operation of the fixing unit, when determined that the fed recording material is an irregular recording material.

17. A method according to claim 15, further comprising a step of reducing a temperature of the fixing unit, when determined that the fed recording material is an irregular recording material.

18. A method according to claim 17, further comprising a step of discharging the recording material after reducing the temperature of the fixing unit.

19. A method according to claim 13, further comprising a step of informing a user of the determination that the fed recording material is an irregular recording material.

20. A method according to claim 13, wherein said reading step uses a reading unit comprising:

an illuminating unit adapted to illuminate an object;

an imaging lens adapted to form an image with reflected light from the object; and a convertor adapted to photoelectrically convert the image formed with the reflected light.

21. A method according to claim 20, wherein the illuminating unit illuminates the recording material obliquely from above, and the convertor receives diffusedly reflected light from the object.

22. A method according to claim 13, wherein the convertor comprises a CCD comprised of a plurality of pixels.

23. A method according to claim 13, wherein the convertor comprises a C-MOS sensor comprised of a plurality of pixels.

24. An image forming apparatus comprising:

a feeding unit adapted to feed a recording material;

an image forming unit adapted to form an image on the recording material fed by said feeding unit;

a reading unit capable of reading an area including a shadow of an edge of the recording material fed by said feeding unit and adapted to generate an image comprising a plurality of pixels each representing a brightness or a darkness;

a determining unit adapted to determine whether or not the recording material is an irregular recording material, based on a size of the shadow comprised of the generated image; and a controlling unit adapted to stop or suppress a specific operation of said apparatus, when determined that the recording material is an irregular recording material.

* * * * *